US007000922B1

(12) United States Patent
Norton

(10) Patent No.: US 7,000,922 B1
(45) Date of Patent: Feb. 21, 2006

(54) BALL PROJECTOR FOR SURFACE PROJECTILE GAME

(76) Inventor: David A. Norton, 4910 W. Linebaugh, Tampa, FL (US) 33624

( * ) Notice: Subject to any disclaimer, the term of this patent is extended or adjusted under 35 U.S.C. 154(b) by 0 days.

(21) Appl. No.: 10/833,660

(22) Filed: Apr. 28, 2004

(51) Int. Cl.
*A63B 63/00* (2006.01)
*A63D 5/02* (2006.01)
*A63F 7/26* (2006.01)

(52) U.S. Cl. ..... 273/352; 273/355; 273/129 R; 124/78

(58) Field of Classification Search ..... 273/352, 273/356–357, 120 A, 129 K, 108.54, 126 R, 273/126 A; 473/446; 124/70, 78; 221/260, 221/265, 277
See application file for complete search history.

(56) References Cited

U.S. PATENT DOCUMENTS 600,712 A 3/1898 Brown
750,988 A 2/1904 Lotz
1,221,903 A * 4/1917 Johnston ..... 40/669
1,919,094 A * 7/1933 Cuchran ..... 473/107
1,941,630 A 1/1934 Smith
2,566,379 A * 9/1951 Strong ..... 473/111
3,171,655 A * 3/1965 Glass et al. ..... 473/77
3,822,688 A * 7/1974 Mayne ..... 124/6
3,899,170 A * 8/1975 Parks et al. ..... 473/107
3,992,006 A * 11/1976 Barlow ..... 273/317.4
4,191,374 A * 3/1980 Kulesza et al. ..... 473/436
4,283,049 A 8/1981 Karlin et al.
4,352,348 A * 10/1982 Griffith ..... 124/78
4,540,181 A * 9/1985 Nelson ..... 273/352
4,705,014 A * 11/1987 Kahelin ..... 124/1
5,255,917 A * 10/1993 Morrow et al. ..... 473/446
5,396,876 A 3/1995 Liscio et al.
5,465,978 A * 11/1995 Magnone et al. ..... 124/7
5,707,304 A * 1/1998 Bellelsle ..... 473/431
6,443,859 B1 * 9/2002 Markin ..... 473/451
2002/0166551 A1 * 11/2002 Lee ..... 127/78

* cited by examiner

*Primary Examiner*—Mark S. Graham
(74) *Attorney, Agent, or Firm*—David Kiewit

(57) ABSTRACT

A mechanical projector for use with an existing table bowling game allows players a choice of speeds at which a projectile is launched along a lane towards a target. This launcher may comprise a relatively soft speed-up roller rotatable about an axis transverse to the lane. Preferred versions of the projector have a ball-clearing mechanism that moves a returning ball, rolling from the target zone toward the player, off to one side of the alley so that the returning ball can bypass the projector and be returned to the player. In addition, a preferred version of the projector may be moved out of its normal operating position to allow for conventional unassisted play.

9 Claims, 3 Drawing Sheets

BALL PROJECTOR FOR SURFACE PROJECTILE GAME

BACKGROUND OF THE INVENTION

1. Field of the Invention

This invention relates to surface projectile games in which a player causes a ball to roll upwards along a slanting surface to engage one or more targets.

2. Background Information

Surface projectile games, such as bowling, table bowling and pinball, sometimes use a mechanical projector or shooter to propel a ball or other projectile along a playing surface towards one or more targets. Many of these games, such as conventional pinball games, are configured so that they can only be played with the mechanical gun. In some games, such as conventional bowling, known mechanisms can be used by a player who is unable to lift and roll something as heavy as a bowling ball. Some such mechanisms are sufficiently mobile that they can be placed at the player's end of an alley when a disabled player bowls and then quickly removed so that a competing able-bodied player can take his or her turn.

BRIEF SUMMARY OF THE INVENTION

One aspect of the invention is that it provides a method of playing a bowling game in which a mechanical projector or launching mechanism is used to propel a ball, puck, or other equi-axed or elongate projectile along a surface toward a target. In preferred games of this sort, at least one target is disposed at a higher elevation than is the projector and the playing surface slopes generally upward from the launch location toward the target zone. Because the table or alley slopes upward from the projector, it is to be expected that some balls, e.g., those that do not reach the target area, will roll back down the alley toward the projector. In order to prevent a ball from becoming lodged against a output portion of the projector, a preferred embodiment of the invention uses a projectile-clearing conveyor arrangement to move returned balls toward an edge of the alley or into a gutter so that they can bypass the projector and be returned to the player for another bowl.

Another aspect of the invention is that it provides a mechanical projector for a table bowling game, the projector extending transversely across a selected portion of an elongated playing surface of the sort generally referred to as a lane or alley that extends from a player's position to a target zone. The launching mechanism comprises an input side adjacent the player and an output side distal from the player as well as one or more rollers, each roller rotating about a respective roller axis transverse to the alley, so that a projectile, such as a ball, received at the input side of an operating launcher, is propelled toward the target. In a preferred embodiment, the rotational speed of the roller, and thus the speed of a ball launched toward the target, is selectively changeable by a player-operated control.

In a preferred embodiment the launching mechanism comprises a launching roller operable in conjunction with a ball-diverting conveyor or clearing device disposed more distally from a player's position than is the roller. The ball-diverting conveyor preferably comprises a belt, chain, or other element arranged for motion transverse to the playing surface. A preferred clearing device comprises a plurality of fingers depending from the belt or chain. The preferred fingers are relatively flexible in a direction along the alley, so as to not interfere with the passage of a ball being launched toward a target; and are relatively stiff in a direction transverse to the alley, so that a returned ball contacted by a moving finger can be propelled transverse to the alley. In a preferred embodiment, the projectile-clearing conveyor is adjacent the output side of a launching roller and is housed in a common housing with the launching roller. That is, the preferred ball-diverting conveyor is disposed between the ball launcher and the target region of the game.

Although it is believed that the foregoing rather broad recital of features and technical advantages may be of use to one who is skilled in the art and who wishes to learn how to practice the invention, it will be recognized that the foregoing recital is not intended to list all of the features and advantages. Those skilled in the art will appreciate that they may readily use both the underlying ideas and the specific embodiments disclosed herein as a basis for designing other arrangements for carrying out the same purposes of the present invention. Those skilled in the art will realize that such equivalent constructions are within the spirit and scope of the invention in its broadest form. Moreover, it may be noted that various embodiments of the invention may provide various combinations of the hereinbefore recited features and advantages of the invention, and that less than all of the recited features and advantages may be provided by some embodiments.

DETAILED DESCRIPTION OF THE INVENTION

In studying this Detailed Description, the reader may be aided by noting definitions of certain words and phrases used throughout this patent document. Wherever those definitions are provided, those of ordinary skill in the art should understand that in many, if not most instances, such definitions apply to prior, as well as future uses of such defined words and phrases. At the outset of this Description, one may note that the terms "include" and "comprise," as well as derivatives thereof, mean inclusion without limitation; the term "or," is inclusive, meaning and/or; "alley" and "lane" denote an elongate playing surface characterized by a direction of play extending from a player's position adjacent one end of the alley or lane towards a target zone disposed adjacent the other of the two ends of the alley or lane; the phrase "table bowling game" stands for any sort of amusement device in which a projectile of some sort is manually launched by a player of the game along an alley or lane; a direction denoted as "transverse to" an alley or lane denotes a direction generally perpendicular to the direction of play; and "surface projectile" stands for a ball, puck, or other object that can be rolled or slid along a lane or alley, the projectile having a thickness measured perpendicular to the surface of the lane and a width measured parallel to the surface of the lane.

Figure 1:
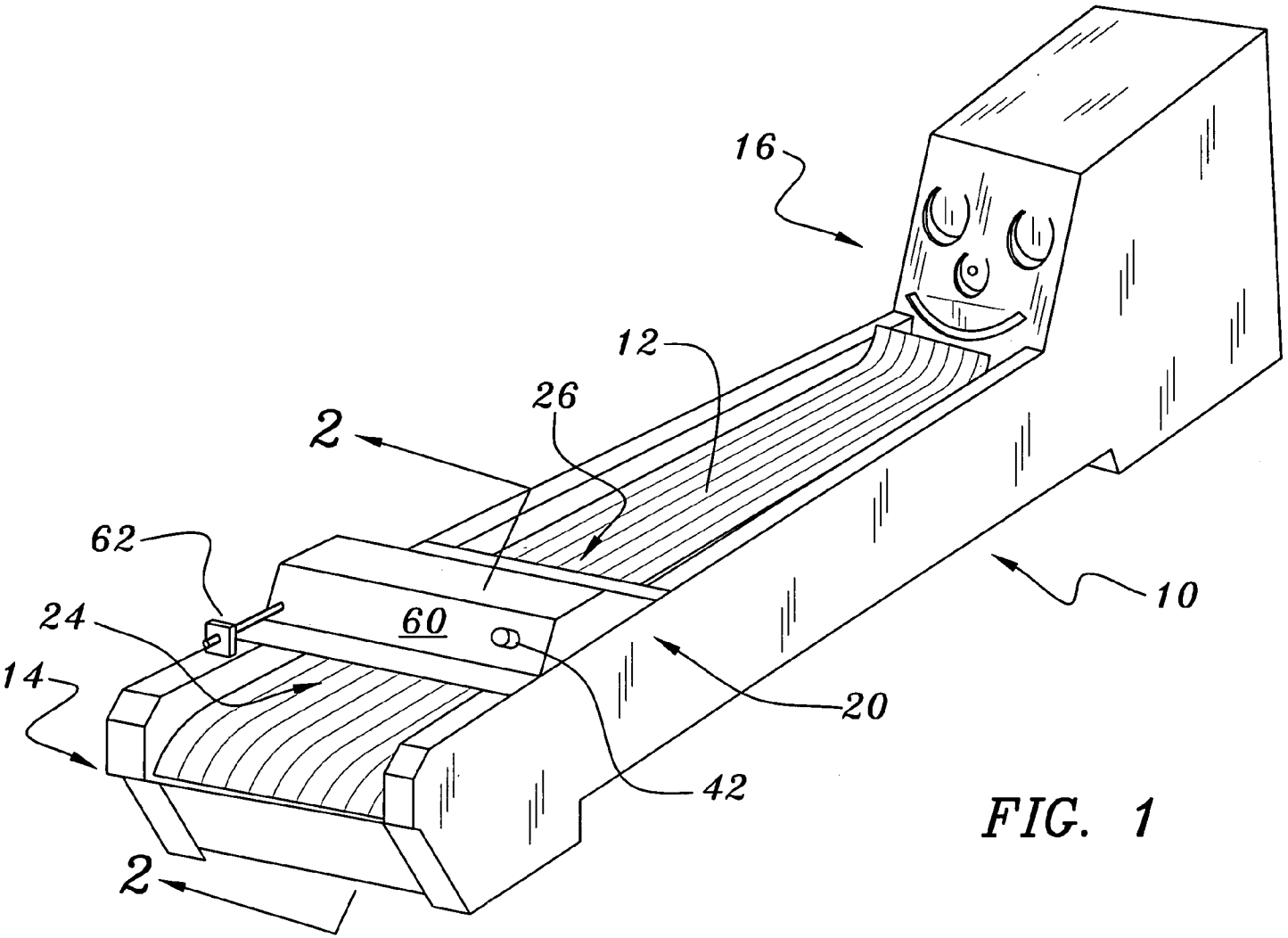
FIG. 1 is an elevational view of a table bowling game having apparatus of the invention installed thereon.

Turning now to FIG. 1, one finds a table bowling game 10 comprising an alley or lane 12 extending from a player's position 14 towards a target area 16 that may have any of a wide variety of targets disposed therein. This depiction differs from well known table bowling games in that a ball projector 20 of the invention is set transversely across the alley 12.

One function of the ball projector 20 is to receive a ball 22 at an input side 24 of the projector and to expel the ball 22 from an output side 26 at a sufficiently high speed to ensure that the ball will reach the target area 16. This allows small children, who can not roll a ball fast enough to reliably get it to the target area, to play the modified table bowling game. This also provides an additional method by which adults, who could bowl to the target area, can play the game.

A preferred projector 20 of the invention comprises an electrically-powered speed-up roller 28 spaced above a selected portion of the alley 12 by less than a diameter or other vertical thickness of a projectile. The roller is rotatable as indicated by the curved arrow 30 in FIG. 2 so as to propel the surface projectile 22 toward the target area 16 in the direction indicated by the heavy arrow 32 in FIG. 2. In a preferred embodiment the roller 28 is relatively soft and deformable in order to reliably grab an incoming ball and to expel it at a well defined speed. Although a wide range of roller configurations can be considered, if the roller is too hard, balls that are not smoothly rolling along the surface of the alley (e.g., those that are bouncing a bit) may bounce off the roller, rather than being grabbed by it. Moreover, an overly hard roller requires either an accurate selection of the spacing between the roller axis 34 and the alley 12 in order to avoid having the ball pass beneath the roller without engaging it, or a more complex mounting arrangement allowing for vertical motion of the roller. Those skilled in the art will recognize that other sorts of projectors could be used and that these include, but are not limited to a multi-roller array or a conveyor belt.

Inasmuch as most table bowling lanes do not have gutters at their sides, the length of the roller 28 is preferably selected to be less than the width of the lane by an amount equal to, or larger than, a width of a projectile. This allows it to extend most of the way across a lane so as to speed up the great majority of balls bowled into it. This arrangement also leaves a gap on at least one side of the lane that is large enough to pass a returning projectile to the player.

In a particular preferred embodiment using a hard wooden ball of the sort commonly used with arcade table bowling games, the roller is an extra-soft nitrile rubber drive roller having a four inch outer diameter and a 20A durometer rating. An exemplar roller satisfying this description is the Model DR-754-20W made by the Fairlane Products Co., of Fraser, Mich. The preferred easily deformed roller has a diameter greater than about three quarters of the diameter of the wooden ball.

The roller 28 is preferably turned by a variable speed electric motor 36 powered by a suitable power supply 38 and coupled to the roller by any suitable drive means such as a drive belt 40 or a gear train (not shown). Although a wide variety of drive mechanisms are possible, preferred mechanism (such as a V-belt drive) allow for some slippage to occur in case of jamming—i.e., so that an operator can determine that a jam has occurred before a motor or other portion of the game is damaged. In preferred embodiments a speed control input 42 is available to the player so that he or she can select a roller speed within a predetermined range of speeds preferably extending from a minimum exit speed at the output side of the launcher that is marginally too slow to allow the ball to reach the target area up to a maximum speed great enough to ensure that the ball reaches the most distant target for whatever ambient conditions of temperature, etc. are expected to be encountered during game service. In some table bowling games a different ball speed at a position along a lane corresponding to the output side of the projector are required in order to hit different targets. The provision of an electrical or electronic speed control thus provides a player with a useful modicum of ball speed control.

Figure 2:
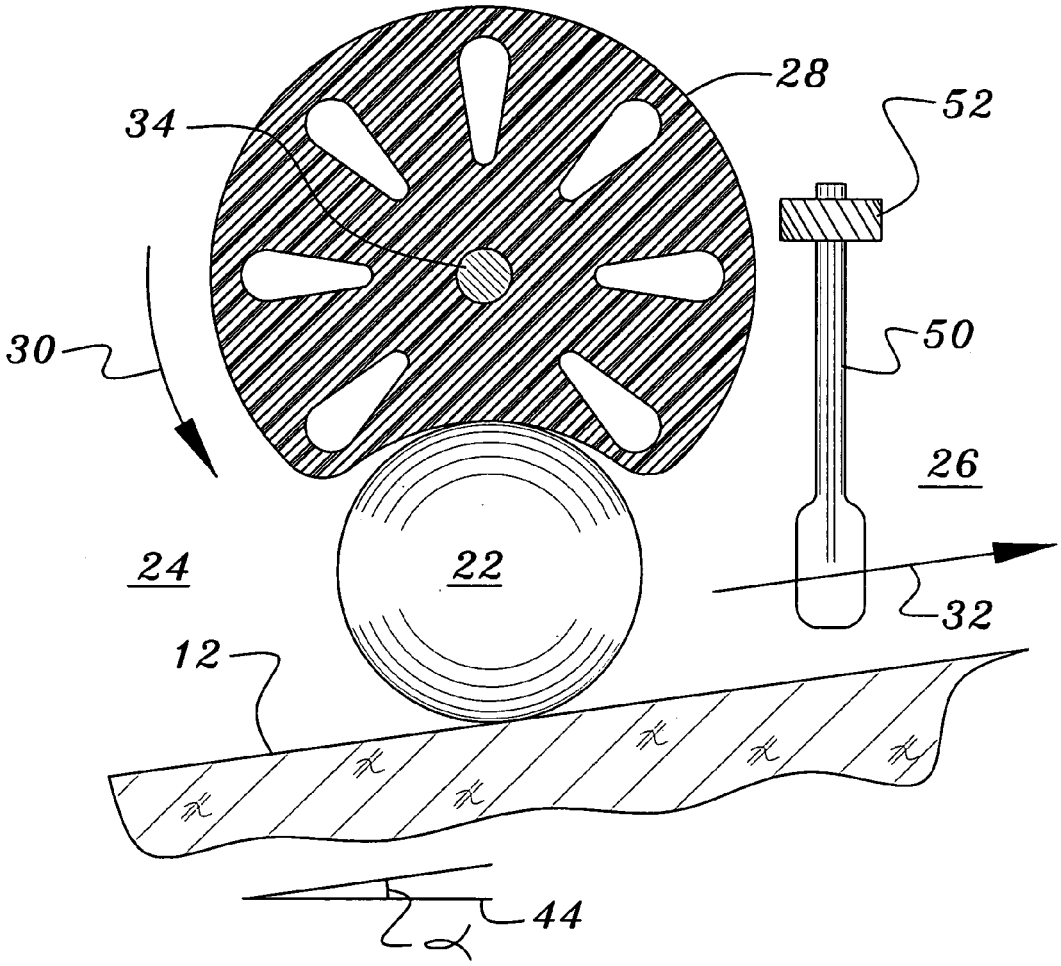
FIG. 2 is a partly schematic cross-sectional view taken as shown by the arrows 2—2 in FIG. 1.
Figure 3:
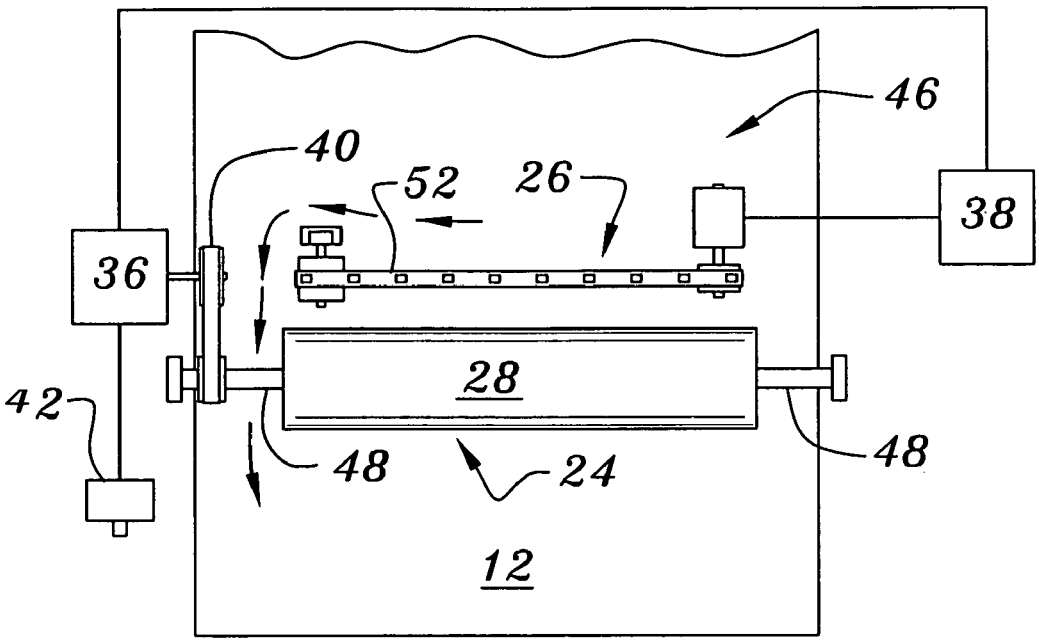
FIG. 3 is a partly schematic cut-way view of apparatus of the invention from which the upper housing has been removed.

Although many bowling games employ a level alley, most table bowling games have an alley that slopes upward from the horizontal 44 by a selected angle (indicated as $\alpha$ in FIG. 2). In such a game, a ball propelled toward a target at too low an initial speed stops partway between the player's end 14 and target area 16 and then rolls back down the alley under the influence of gravity. If a projector comprising a speed-up roller 28 is used with such a game, one must consider how to avoid getting stuck in a situation in which a ball rolls back down the alley, contacts the output side of the roller, and then is again propelled only part way up the alley. In preferred embodiments of the invention a projectile clearing device 46 located between the roller 28 and the target area 16 is used to sweep "rollback" balls off to one side of the alley where they can roll past the roller to the player's position. If the game with which the projector 20 is being used provides one or more return gutters immediately adjacent the alley surface, any ball swept into a gutter can pass beneath the speed-up roller 28. In most table bowling games, however, there is no such gutter, which leads one to select a roller 28 having a length that is less than the width of the alley 12 so as to provide a clearance region 48 at one or both sides of the roller.

Figure 4:
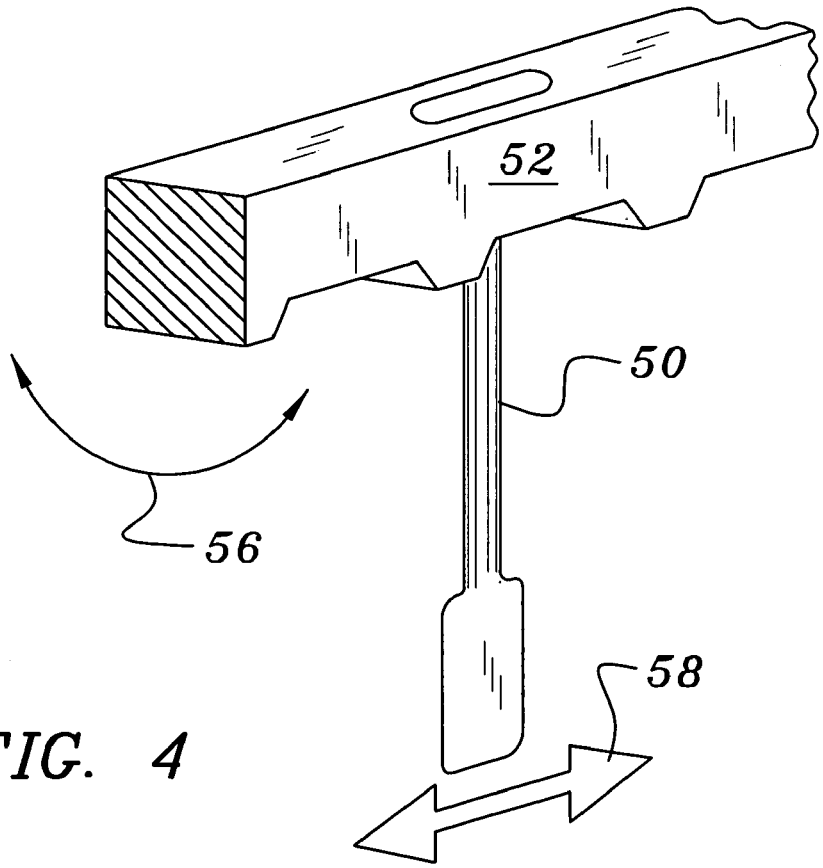
FIG. 4 is a detail sectional view of a preferred returned ball impeller of the invention.

Because the preferred projectile-clearing paddles 50 are located essentially at the output of the speed-up roller 28, it should be clear that some of the balls projected up the alley 12 will strike a paddle. If the paddle, or other projectile-clearing element, was chosen to be uniformly stiff in all directions, this could be a serious operating problem for the game. In a preferred clearing device 48, however, the stiffness of at least a portion of the mechanism is directionally anisotropic and varies so that projectiles incident on the output side of the projector are cleared by being moved transverse to the alley while normally propelled projectiles are largely unaffected by incidental impact with a deflectable portion of the clearing mechanism. In a particular preferred embodiment, this anisotropic stiffness feature was provided by using a relatively thin drive belt 52 movable transverse to the alley 12 by means of an electric motor 54. The belt 52 could be easily twisted (as indicated by the curved arrow 56 in FIG. 4). Thus, when a ball propelled by the speed-up roller 28 struck a paddle 50, the belt twisted and the paddle deflected upwards out of the way. On the other hand, the narrow belt was relatively stiff in a direction along its plane of motion (indicated by the white arrow in FIG. 4) transverse to the lane, and the paddles 50 were selected to be inflexible as well. Hence, a ball rolling back down the lane was stopped by impact with the roller and then swept off to one side where it passed the end of the roller 28 and was returned to the player's end of the table.

The belt 52 depicted in FIG. 2 was preferably mounted very close to the roller so that a returning ball could not be trapped between the linear array of paddles 50 and the roller 28. Enhancements to the experimentally tested arrangement may comprise means, such as a flat metal plate (not shown) that is nearly tangent to the roller 28; the use of a roller chain that is stiffer and more durable than the belt; and the use of hinges in the paddles in order to both increase the clearing device's stiffness 46 transverse to the alley (i.e., along the roller axis) and to decrease its stiffness along the alley axis.

Although a prototype apparatus used the belt and fingers arrangement described above, it will be recognized that other arrangements may also be used to yield an equivalent anisotropically stiff projectile-clearing mechanism. In particular, it is expected that a roller chain, of the sort commonly used on bicycles, could be used in lieu of the flexible belt. This chain could carry a plurality of metal finger assemblies, each comprising a base portion fixed to the chain and a finger portion hingedly attached to the base by means of a hinge extending along the chain or other carrier so that the bottom end of any hinged finger hit by a ball that was being propelled out of the projector would be lifted out of the way without seriously impeding the ball. A preferred finger assembly of this sort would be readily deflectable when hit by a normally projected ball, but would not deflect in the opposite direction. Whether or not the finger assembly hinge allowed for deflection in one direction or two it would provide a finger that was stiff when impacted in a direction transverse to the bowling lane. Hence, any ball returning back down the lane and entering the output side of the projector would be stopped, either by contact with the roller, or by encountering one or more fingers that would not be deflected. In either event, the returning ball would then be swept off to a selected side of the lane where it could bypass the roller and be returned to the player.

The apparatus of the invention thus provides for projector-assisted play of a table bowling game or the like by people who would otherwise be prohibited by their lack of strength or coordination from bowling a ball from a player's position to a target area of the game. Although the preferred apparatus may also be used by able-bodied players to provide a different way of playing an otherwise familiar game, it is clear that while this apparatus is in operative position across a bowling alley, normal, manual, non-assisted play is seriously impeded if not impossible. In various preferred embodiments, different mechanisms are provided that allow a player to readily move the projector 20 out of its operative position into a manual play position in which it does not interfere with manual bowling. This may be done by providing parallel arms at either end of the projector's housing so that it can be lifted vertically above the alley, or by providing a hinge arrangement 62 that allows the projector 20 to be swung out of the way when not in use. Because pivoting the apparatus upward about the hinge 62 exposes movable parts of the apparatus, a preferred embodiment using a hinge 62 also incorporates one or more position sensitive cut-off switches (not shown) to shut down the projector 20 when it is lifted into its manual-play position.

Although the present invention has been described with respect to several preferred embodiments, many modifications and alterations can be made without departing from the invention. Accordingly, it is intended that all such modifications and alterations be considered as within the spirit and scope of the invention.

What is claimed is:

1. A mechanical projector for moving a projectile along a surface of a lane extending upwards from a player's position toward a target zone, the projector having an input side proximal the player's position and an output side distal therefrom, the projector comprising:

a roller rotatable by an electrically powered drive mechanism about an axis that is transverse to the lane and that is a selected vertical spacing above the lane when the projector is operating, the vertical spacing selected so that a lowest portion of the roller is separated from a selected portion of the playing surface by no more than a thickness of the projectile when the projector is operating; and an electrically powered projectile-clearing mechanism disposed between the roller and the output side of the projector, the projectile-clearing mechanism operable to move a projectile incident on the output side of the projector transversely beyond the selected portion of the playing surface.

2. The projector of claim 1 wherein the projectile-clearing mechanism comprises a plurality of depending fingers movable along a line parallel to the axis of the roller, each of the fingers readily deflectable in at least one direction perpendicular to the axis of the roller, each of the fingers not readily deflectable in a direction parallel to the axis of the roller.

3. The projector of claim 1 wherein the roller is deformable and the roller is separated from the selected portion of the playing surface by less than the thickness of the projectile when the projector is operating.

4. The projector of claim 1 further comprising a speed controller operable by the player to control a speed at which the electrically powered drive mechanism turns the roller.

5. The projector of claim 1 wherein the roller has a length that is at least a projectile-width less than a width of the selected portion of the lane.

6. Apparatus for a table bowling game in which a player launches a projectile along a surface of a lane from a player's position towards at least one target, the apparatus selectably usable for one of manual play and projector assisted play, the apparatus comprising:

a table bowling lane sloping upwards from the player's position towards the at least one target;

an electrically powered ball projector movable between a manual play position in which the ball projector does not contact the projectile and a projector assisted play position in which the electrically powered projector is disposed adjacent the surface of the lane and operable to receive the projectile launched by the player and to impel the received projectile along the surface towards the target at a selected speed; and a speed controller operable by the player to select the selected speed from a predetermined range of speeds.

7. The apparatus of claim 6 wherein the projector is pivotally attached adjacent a side of the lane so that the projector can be swung upwards from the projector assisted play position to the manual play position.

8. The apparatus of claim 6 wherein the projector comprises, a roller rotatable about an axis that is transverse to the lane and that is a selected vertical spacing above the lane when the projector is operating, the vertical spacing selected so that a lowest portion of the roller is separated from a selected portion of the playing surface by no more than a thickness of the projectile when the projector is operating.

9. The apparatus of claim 6 further comprising an electrically powered projectile-clearing mechanism disposed adjacent an output side of the projector, the projectile-clearing mechanism operable to move a projectile incident on the output side of the projector transversely beyond the selected portion of the playing surface.

* * * * *